United States Patent [19]

Schwarz

[11] 4,288,099

[45] Sep. 8, 1981

[54] ADHESIVE CONNECTION OF A BODY HAVING A BASE PLATE WITH A SKI

[76] Inventor: Günter Schwarz, Steinacherstr. 67, 8804 Au, Switzerland

[21] Appl. No.: 4,913

[22] Filed: Jan. 18, 1979

[30] Foreign Application Priority Data

Jan. 26, 1978 [CH] Switzerland ..... 836/78

[51] Int. Cl.[3] ..... A63C 11/00

[52] U.S. Cl. ..... 280/817

[58] Field of Search ..... 280/11, 37 E, 11, 37 R, 280/601; 280/817, 601, 809

[56] References Cited

U.S. PATENT DOCUMENTS 3,910,593 10/1975 Schwarz ..... 280/11.37 E 4,135,729 1/1979 Brangenberg ..... 280/11.37 E

*Primary Examiner*—Joseph F. Peters, Jr.

*Assistant Examiner*—Milton L. Smith

*Attorney, Agent, or Firm*—Werner W. Kleeman

[57] ABSTRACT

A body has a base plate having an adhesive connection to a ski and especially with its scoop-like tip region, the adhesive appearing between an additional attachment plate and the ski. Between the attachment plate and the base plate of the body there is provided an elastic connection which is formed by a tongue-like part produced at the base plate of the body, this tongue-like part being resiliently bendable.

12 Claims, 9 Drawing Figures

Fig. 1
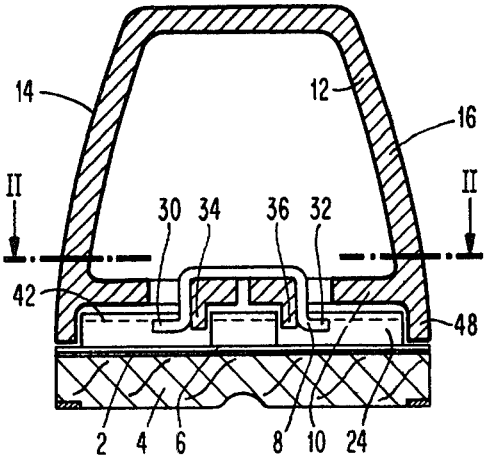
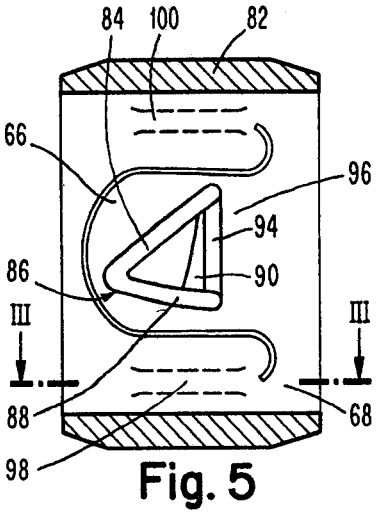
Fig. 5
Fig. 2
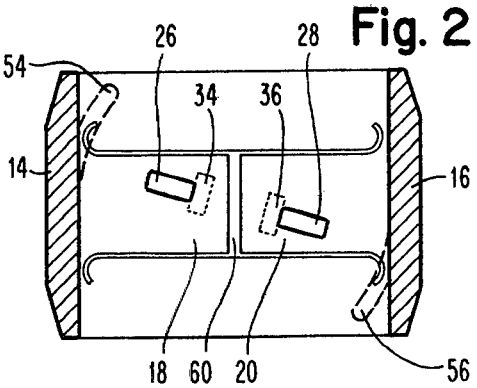
Fig. 6
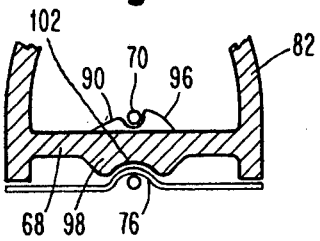
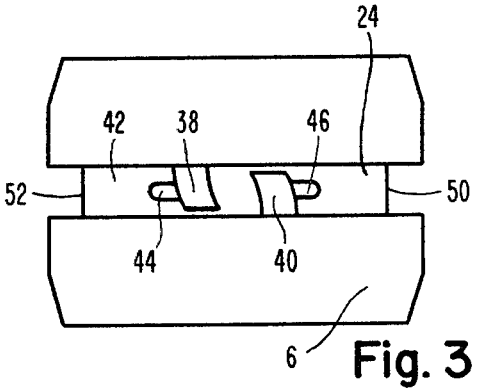
Fig. 3
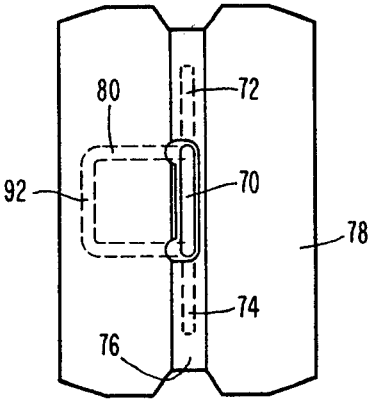
Fig.4

ADHESIVE CONNECTION OF A BODY HAVING A BASE PLATE WITH A SKI

BACKGROUND OF THE INVENTION

The present invention relates to an adhesive connection or bonding of a body having a base plate with a ski or the like.

The attachment of a body to a ski is associated with appreciable difficulties since the ski normally is composed of a number of mutually glued together layers and during use of the ski such is exposed to elastic bending deformations. Attachment of a body by means of bolts or screws to the ski, particularly at the region of the scoop-like tip portion of the ski is disadvantageous in terms of the elastic behavior and the resistance of the ski, since the mutually interacting layers of the ski can be bound together by the bolts or screws. Additionally, it is to be appreciated that the ski at its tip region is so thin that screws or the like do not afford adequate fixing or connection. The direct adhesive attachment or bonding of the relatively rigid base plate of a body on the ski prevents the ski from freely bending at the region of the adhesive connection, so that either the adhesive connection or bond or the glue between the layers of the ski is destroyed. Such direct type of adhesive bonding is also easily destroyed by the force of the blows which act upon the body and which impacts or blows are to be clearly expected during skiing.

Now in order to avoid these disadvantages the inventor of this application has already proposed an adhesive connection or bond for a body having a base plate with a ski wherein there is provided a thin and/or bendable attachment plate having the adhesive surface, the attachment plate being releasably connected by means of at least one connection device with the base plate. Additionally, between the base plate and the attachment or connection plate there is arranged an elastic disk. This elastic disk renders possible an extensive independent bending of the attachment plate during the drastic deformation of the ski as well as a dampening of the impact forces which act upon the body. This adhesive connection or bond has been described in detail in German Pat. No. 33 28 084, which corresponds to U.S. Pat. No. 3,910,593 to which reference may be readily had and the disclosure of which is incorporated herein by reference, and has been found to be extremely satisfactory in practice. What is however disadvantageous is that in order to obtain an elastic connection with the attachment plate there must be additionally provided at least one connection element of an elastic member, i.e., the elastic disk, and by virtue of which the adhesive connection is complicated and expensive. In order to avoid this drawback the inventor of this application has further proposed, as taught in Swiss Pat. No. 589,459, the use of a thin and/or bendable attachment plate having the adhesive surface, and which attachment plate is releasably connected by means of at least one connection or attachment device with the base plate, and wherein there is avoided the use of such elastic element or member. However, it has been found that this simpler construction does not possess any satisfactory reliability and from time to time there occurs disconnection of the attachment plate from the ski.

SUMMARY OF THE INVENTION

It is therefore a primary object of the present invention to avoid the aforementioned drawbacks and limitations of the prior art proposals discussed above.

Another and more specific object of the present invention aims at the provision of an adhesive connection possessing increased reliability while affording a simpler construction, i.e., utilizes less parts and can be produced more easily.

Now in order to implement these and still further objects of the invention, which will become more readily apparent as the description proceeds, the invention is manifested by the features that each attachment or connection device is connected, on the one hand, with an intermediate region of the attachment plate and, on the other hand, with at least one tongue-like part extending parallel to the base surface of the body and which in one piece is narrower than the base surface of the body.

By virtue of the fact that each attachment or connection device is connected with an intermediate or central region of the attachment plate there is avoided concentration of stresses upon application of a force by the bodies via the attachment or connection device at the edge of the attachment plate, which could lead to destruction of the adhesive bond between the attachment plate and the top surface of the ski. By virtue of the invention there is further utilized in an advantageous manner the bending elasticity of a part of the body, i.e., the tongue-shaped part for dampening or absorbing the impact forces acting upon the body, without there being required an additional part for the adhesive bond.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a cross-sectional view directed transversely of a ski of an attachment body for the ski for serving to prevent the undesired cross-over of the skis;

FIG. 2 is a horizontal sectional view through the attachment body of FIG. 1 taken substantially along the line II—II thereof, wherein the wire bracket of the arrangement of FIG. 1 has been here omitted to simplify the illustration;

FIG. 3 is a plan view of the attachment or connection plate of the adhesive connection or bond of FIG. 1;

FIG. 4 is a plan view of an attachment plate of a further embodiment of the invention;

FIG. 5 is an illustration, corresponding to the showing of FIG. 2, of a further embodiment of the invention;

FIG. 6 is a partial cross-sectional view looking in the lengthwise direction of the ski through the adhesive connection of the exemplary embodiment of FIGS. 4 and 5;

DETAILED DESCRIPTION OF THE PREFERRED EMBODIMENTS

Figure 7:
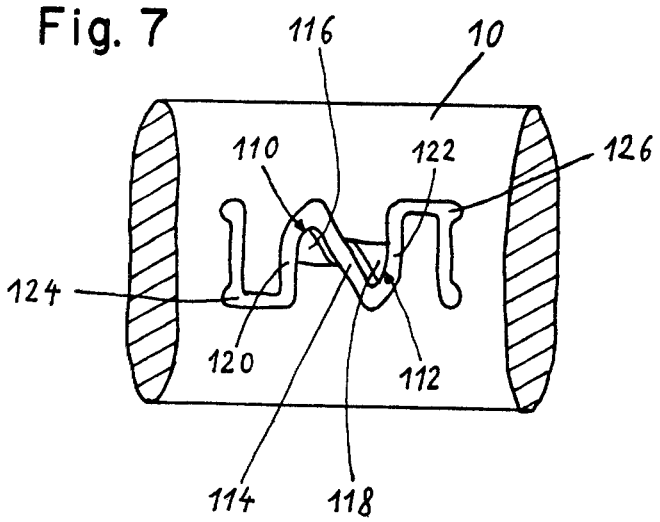
FIG. 7 is an illustration, corresponding to the showing of FIG. 2, of a third exemplary embodiment of the invention.

Turning now to the drawings, the illustration of FIG. 1 shows an adhesive connection or bond comprising an attachment or connection plate 6 which is connected by means of an adhesive layer 2 with the ski 4 and a connection or attachment device between the base plate 10 of a body 12 and the attachment plate 6 and which connection device comprises a wire bracket 8. Depending upon whether the attachment body 12 is secured to the right or left ski by means of the inventive adhesive connection either its left or its right side surface 14, 16 is capable of preventing the undesired cross-over of the other ski. The forces or impact blows acting in a sudden-like manner upon the attachment body 12, encountered during skiing against a hinderance or upon the dropping of an upright ski, are transferred by means of two elastically bendable tongue-like parts 18, 20 of the base plate 10 and the wire bracket 8 to an intermediate or central region of the attachment plate 6. The wire bracket 8 can be releasably connected or latched in an upwardly bent or flexed channel portion 24 of the attachment plate 6.

At the region of the tongue-shaped parts or elements 18, 20 there are located in the base plate 10 two respective relatively short slots 26, 28 for the passage of the outwardly bent ends 30, 32 of the wire bracket 8. Along the inner edges of these slots 26, 28 there downwardly extend from the base plate 10 two projections 34, 36 along the leg of the wire bracket 8. These projections 34, 36 are assigned the task of preventing the bracket legs from bending inwardly towards one another in the presence of larger forces. The wire bracket 8 is fixedly retained with a pre-bias or stress in the slots 26, 28 in the base plate 10. For establishing a locking to the channel shaped upwardly flexed portion 24 of the attachment plate 6 the attachment body 12 is mounted thereon in a slightly offset turned position and can be aligned in the conventional position of use on the ski 4 by rotating the same through a relatively small angle. During this rotational movement a respective vertically directed leg of the bracket 8 together with the adjoining projection 34 and 36 pivots in each case towards a recess 38, 40 of the upwardly flexed part or portion 24 of the attachment plate 6 and the outwardly protruding bracket ends 30, 32 move below the upper wall part 42 of the channel shaped, upwardly flexed portion 24 of the attachment plate 6. Bounding the recesses or portions 38, 40 there can be provided on the upper marginal part a small downwardly directed, bulbous or protuberance-like projection 44, 46 by means of which the related bracket end 30, 32 can move into its latching position. In order to obtain the latching or locking position there can be provided an the underside of the base plate 10, similar to the exemplary embodiment of FIG. 6, raised portions or protuberances having a bulge which latch or lock by means of the channel-shaped, upwardly bent part 24 under a pre-bias or stress, i.e., under the stress of the tongue-shaped parts 18, 20.

For the reception of the channel-shaped, upwardly flexed part 24 of the attachment plate 6 there is provided an edge 48 on the body 12 which protrudes downwardly past its base plate 10. This downwardly protruding edge 48 lockingly engages the ends 50, 52 of the upwardly flexed part or portion 24 of the attachment plate 6: these ends 50 and 52 being inwardly offset from the edge of such attachment plate 6. In order to center the rotational movement during establishment of the releasable connection of the body 12 with the attachment plate 6 there can extend at least one arcuate-shaped guide rib 54, 56 from the edge 48 tangentially below the base plate 10. Along the guide ribs 54, 56 there can be guided, during the rotational movement, the related end 50, 52 of the upwardly flexed part 24. These ribs have been shown schematically in FIG. 2 by the broken lines.

Instead of the channel-shaped, upwardly flexed part 24 there also can be provided a domed part which is limited to the intermediate region of the attachment plate 6, in which case the guide ribs or a cylindrical guide edge can be arranged further towards the center of the base plate 10. An upwardly flexed part which extends transversely with respect to the lengthwise direction of the ski over the attachment plate 6, as is also provided for the embodiment of FIG. 4 and FIG. 6, respectively, has the advantage that the attachment plate can more easily bend while following the bending movement of the ski and prevents any stiffening of the attachment plate due to doming.

Figure 8:
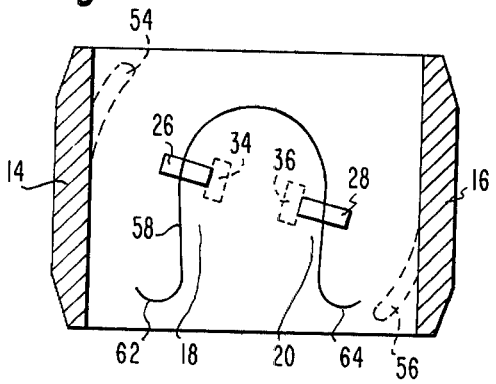
FIG. 8 shows an alternate embodiment of FIG. 2.

In FIG. 8 there is indicated by lines 58 a second embodiment for the construction of the tongue-shaped part. Along this line 58 there extends a slot which limits the tongue-shaped part. The slots 26, 28 of the base plate 10 extend transversely over the slot, and there can be avoided an intermediate slot 60 which separates both confrontingly directed tongue-shaped parts 18, 20 of the first exemplary embodiment. Just as was the case for the tongue-shaped parts 18, 20 the slot ends 62, 64 are outwardly curved at the region of the tongue root, so that there can be avoided stress concentrations at the slot ends. According to a further exemplary embodiment of the invention as shown in FIGS. 4 to 6 there is likewise provided only one tongue-shaped part 66 which can be similarly constructed. The outer ends and the root region of the tongue-shaped part 66 are likewise located in spaced relationship from the marginal edge of the base plate 68. Also in this case there is used a wire bracket 70 as the attachment or connection device, with the difference that for the establishment of the releasable connection with the attachment plate it is secured on such and not as with the previously described exemplary embodiments on the base plate. The outwardly spread ends 72, 74 indicated by broken lines in FIG. 4 are rotatably guided about their lengthwise axis in a channel-shaped flexed or bent-out portion 76 of the attachment plate 78, so that the bracket portion 80 of the wire bracket can be pivoted to lie flat upon the attachment plate, as indicated by broken lines in FIG. 4. In this way there is avoided the need to use a rigid bolt or the like which protrudes upwardly from the attachment plate and is associated with the danger that it can cause injury. In order to produce the connection of the body 82 with the attachment plate 78, the bracket portion 80 is rocked upwardly, so that it protrudes vertically from the attachment plate, and is introduced into the part 84 of an approximately angle-shaped slot 86 of the base plate 68. The body 82 is located in a turned position upon the ski and after rotating this body 82 into its normal position of use the one vertical leg of the wire bracket 70 slides along the arcuate-shaped slot portion 88. The slot portions 84, 88 delimit a cam-like raised portion or protuberance 90 over which there can slide the bracket part 92 which interconnects the bracket legs during its rotational movement, so that the tongue-shaped part 66 is resiliently downwardly pressed. After overcoming the highest point of the protuberance 90 this bracket part 92 latches in a groove 94 which, on the one hand, is bounded by the protuberance 90 and, on the other hand, by an impact protuberance or raised portion 96. Two further latching positions are provided by two web-like raised portions or protuberances 98, 100, formed on the underside of the base plate 68, and having a recess 102, the cross-section of which corresponds to the outer cross-sectional shape of the channel-shaped, upwardly flexed portion or part 76. In this way there is afforded a reliable securement of the body against rotation and release of the connection. The size of the web-shaped protuberances 98, 100 is determined by the cam-like raised portion or protuberance 90 and has only been shown by way of example in the drawings and can be appropriately dimensioned in accordance with the spring force which is strived for during the spring movement or resilient action of the tongue-shaped part 66.

Figure 9:
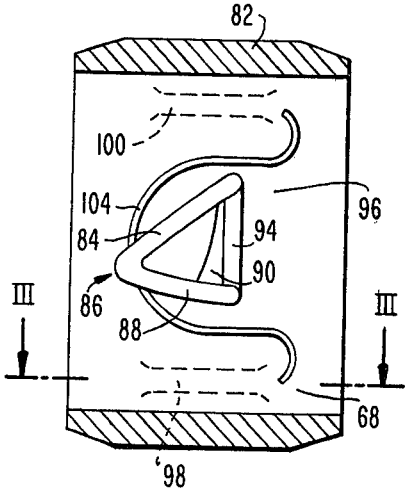
FIG. 9 shows an alternate embodiment of FIG. 5.

Now in FIG. 9 there is shown by lines 104 a slot which emanates from the angular slot 86 and constitutes a different embodiment of the tongue-shaped part 66.

The intensity of the spring force, during the deflection of the tongue-shaped part 66 or the tongue-shaped parts 18, 20 of the first exemplary embodiment, can be determined by the selection of the thickness of the base plate 10, 68, by the width of the root region of the tongue-shaped part as well as by the material of the base plate.

It should be understood that numerous modifications of the connection or attachment device between the attachment plate and the base plate of the body or a part of the body are possible, under the precondition that each attachment or connection device is connected on the one hand with the intermediate region of the attachment plate and, on the other hand, with at least one tongue-shaped part which extends parallel to the base surface of the body. The latching of an end to the attachment device, as also illustrated by the described exemplary embodiments, can be accomplished either at the attachment plate or at the tongue-shaped part. Furthermore, the attachment device can consist of a separate part, such as for instance a wire bracket 8, 70, which either is non-releasably connected with the tongue-shaped part, as in the embodiment of FIGS. 1 and 2, or with the attachment plate, as in the embodiment of FIGS. 4 to 6. The non-releasable connection can be movable or also rigid and the attachment device can also be directly formed of one-piece with the base plate or the attachment plate.

Although by virtue of the present invention there is avoided the need for an additional spring or resilient part, it nonetheless can be permissible to provide the same, for instance in the form of a rubber elastic layer between the base plate and the transversely extending part of the wire bracket 8, between the protruding ends of the wire bracket and the upper marginal portion 42 of the upwardly flexed part 24 or between the base plate 10 and the attachment plate 6.

In the exemplary embodiment of FIG. 7 there are provided two tongue-shaped parts 110 and 112 which can exert a resilient or spring action independently of one another. They are located adjacent one another and their free ends are directed in opposite directions. A slot 114 separates them from one another, through which there is inserted the wire bracket 8, 70 upon passing through the base plate 10 before its part extending parallel to the base plate 10 can slide away into the latching or blocking position by rotating the body 12 and thus enabling the base plate 10 to slide into the latching position by means of the raised portions or protuberances 116, 118 of the tongue-shaped parts 110, 112. The guide slots 120, 122 for the legs of the wire bracket 8, 70, and which guide slots outwardly bound the tongue-shaped parts 110, 112, outwardly merge into the further slots 124, 126, so that the resilient action of the tongue-shaped parts 110, 112 relative to the remaining part of the base plate 10 is facilitated.

While there are shown and described present preferred embodiments of the invention, it is to be distinctly understood that the invention is not limited thereto, but may be otherwise variously embodied and practiced within the scope of the following claims. Accordingly,

What I claim is:

1. An adhesive connection between a body having a base plate and a ski, especially with the scoop-like tip portion of the ski, comprising:

a bendable attachment plate having an adhesive surface for securing the plate to the ski;

at least one attachment device for releasably connecting the attachment plate to the base plate of the body;

said base plate having at least one substantially tongue-shaped part, said tongue-shaped part being part of the base plate of said body and extending essentially parallel to a base surface of the body;

said attachment device being connected to an intermediate region of the attachment plate and to said at least one tongue-shaped part; and said tongue-shaped part being narrower than the base surface of the body and being located in spaced relation from the attachment plate so that it is resiliently movable in the direction of said attachment plate.

2. The adhesive connection as defined in claim 1, wherein:

said tongue-shaped part has outer ends and a root region which are arranged in spaced relationship from the edge of the base plate of the body.

3. The adhesive connection as defined in claim 1, wherein:

said attachment device comprises a wire bracket;

said wire bracket being pivotably secured to the attachment plate for pivotable movement about an axis parallel to said attachment plate;

said wire bracket having a bracket portion;

said base plate having a slot means;

said bracket portion extending through said slot means of the base plate;

said slot means forming a boundary for the tongue-shaped part;

said tongue-shaped part having a free end provided with a cam-like protuberance;

said wire bracket having a transverse part which is displaceable over said cam-like protuberance into a latching position by rotating said body.

4. The adhesive connection as defined in claim 3, wherein:

said base plate is provided with two of said tongue-like parts which are arranged adjacent one another;

said base plate having a throughpassage slot for said bracket portion;

said throughpassage slot separating said two tongue-shaped parts from one another;

said tongue-shaped parts having free ends which are directed opposite to one another.

5. An adhesive connection between a body having a base plate and a ski, especially with the scoop-like tip portion of the ski, comprising:

an attachment plate having an adhesive surface for securing the plate to the ski;

at least one attachment device for releasably connecting the attachment plate with the base plate of the body;

said base plate having at least one substantially tongue-shaped part extending essentially parallel to a base surface of the body;

said attachment device being connected with an intermediate region of the attachment plate and to said at least one tongue-shaped part;

said tongue-shaped part being narrower than the base surface of the body; and said base plate of said body is provided with a slot which surrounds said tongue-shaped part.

6. The adhesive connection as defined in claim 5, wherein:

said slot has ends which are curved outwardly away from the tongue-shaped part.

7. The adhesive connection as defined in claim 5, wherein:

said attachment plate comprises a channel-shaped, upwardly flexed part capable of being arranged transversely with respect to the lengthwise axis of the ski;

said channel-shaped part serving for the connection of an end of the attachment device;

the channel-shaped, upwardly flexed part is shorter than the outer dimension of the body in such direction; and said body having a downwardly protruding edge which surrounds the upwardly flexed part.

8. The adhesive connection as defined in claim 7, wherein:

said base plate has an underside provided with at least one guide rib for an end of the channel-shaped, upwardly flexed part.

9. The adhesive connection as defined in claim 5, wherein:

said attachment plate comprises a channel-shaped, upwardly flexed part capable of being arranged transversely with respect to the lengthwise axis of the ski;

said channel-shaped part serving for the connection of an end of the attachment device;

said base plate has an underside provided with at least one protuberance having a bulge means which surrounds a region of the channel-shaped, upwardly flexed part.

10. The adhesive connection as defined in claim 5, wherein:

said attachment plate comprises a channel-shaped, upwardly flexed part capable of being arranged transversely with respect to the lengthwise axis of the ski;

said channel-shaped part serving for the connection of an end of the attachment device;

said attachment device is secured to the base plate;

said attachment device having two projections extending at least approximately parallel to the attachment plate; and said two projections being lockingly introducable below an upper wall portion of the channel-shaped, upwardly flexed part by accomplishing a rotational movement of the body.

11. The adhesive connection as defined in claim 10, wherein:

said channel-shaped, upwardly flexed part has an upper wall; and at least one bulbous-like protuberance provided at the region of the pivotal projections on the underside of the upper wall of said channel-shaped, upwardly flexed part.

12. The adhesive connection as defined in claim 10, wherein:

said attachment device comprises a wire bracket having downwardly directed legs; and said base plate has downwardly extending projection means which bear on the downwardly directed legs at the inner side thereof.

* * * * *